US006769328B1

(12) United States Patent
Patel et al.

(10) Patent No.: US 6,769,328 B1
(45) Date of Patent: Aug. 3, 2004

(54) HAND TOOL

(75) Inventors: Amit Patel, Irving, TX (US); Ajay Garg, Plano, TX (US)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 10/349,915

(22) Filed: Jan. 24, 2003

(51) Int. Cl.[7] ..... B25B 13/00
(52) U.S. Cl. ..... 81/59.1; 192/45; 192/45.1
(58) Field of Search ..... 81/59.1, 63.1, 81/62; 192/45, 43.1, 45.1, 43.2, 44

(56) References Cited

U.S. PATENT DOCUMENTS

| | | | | |
|---|---|---|---|---|
| 1,242,201 A | | 10/1917 | Keller | |
| 2,408,335 A | | 9/1946 | Oliver et al. | |
| 2,584,256 A | | 2/1952 | Brown | |
| 4,051,935 A | | 10/1977 | Nakayama | |
| 5,086,673 A | * | 2/1992 | Korty | 81/59.1 |
| 5,115,699 A | | 5/1992 | Mertens | |
| 5,199,329 A | | 4/1993 | Hsu | |
| 5,651,294 A | * | 7/1997 | Shiao | 81/59.1 |
| 5,697,267 A | | 12/1997 | Tsai | |
| 5,752,590 A | * | 5/1998 | Lin | 192/44 |
| 5,941,140 A | | 8/1999 | Suksi | |
| 6,067,881 A | | 5/2000 | Albertson | |
| 6,112,624 A | | 9/2000 | Chen | |
| 6,202,513 B1 | | 3/2001 | Pan | |
| 6,253,646 B1 | * | 7/2001 | Chang | 81/59.1 |
| 6,267,027 B1 | * | 7/2001 | Mitchell | 81/59.1 |
| 6,276,239 B1 | | 8/2001 | Albertson | |

* cited by examiner

*Primary Examiner*—Lee D. Wilson
(74) *Attorney, Agent, or Firm*—Pillsbury Winthrop LLP

(57) ABSTRACT

A hand tool for applying a torque to a threaded fastener includes a tool body having an opening and a fastener engaging mechanism rotatably mounted in the opening. A control assembly comprising a cylindrical roller, spring assembly and control switch are mounted with respect to the tool body. The spring assembly biases the roller against surfaces on the tool body and the fastener engaging mechanism. The roller the releasably locks the faster engaging mechanism to the tool body when the tool body is rotated through a drive stroke. The tool body can be moved through drive and return strokes of any arc length with no significant lost motion.

10 Claims, 6 Drawing Sheets

HAND TOOL

FIELD OF THE INVENTION

The present invention relates to hand tools for rotating threaded fasteners. More specifically, illustrative embodiments of the present invention relate to wrenches of the type that can be removablely coupled to fasteners and moved alternately through drive and return strokes while remaining attached to the fastener. Movement of a wrench through its drive stroke drives the fastener, but the fastener remains stationary as the wrench moves through its return stroke.

BACKGROUND OF THE INVENTION

Some wrenches (e.g., socket wrenches) include a fastener engaging mechanism that is rotatably mounted within an opening in an elongated tool body. The fastener engaging mechanism is constructed to be removablely coupled in force-applying relation to a threaded fastener. The fastener engaging mechanism may include a rectangular post to which is coupled a removable socket for engaging the fastener or, alternatively, the fastener engaging mechanism may be in the form of an annular or ring-shaped socket that can be coupled directly to a fastener. The wrench can be moved alternately through drive and return strokes to drive the fastener while remaining coupled to the fastener.

Specifically, when the fastener engaging mechanism is removablely coupled to a threaded fastener and the tool body is rotated in a first rotational direction through a drive stroke, the fastener engaging mechanism rotates with the tool body causing the fastener to rotate. When the tool body is rotated in a second direction opposite the first direction through a return stroke, the fastener engaging mechanism and the fastener remain stationary relative to the tool body. Movement of the tool body again in the driving direction drives the fastener engaging mechanism and the fastener in the first rotational direction. The driving and return directions of the wrench can typically be reversed.

Conventional wrenches of this type include a spring biased pawl mechanism operatively connected between the fastener engaging mechanism and the tool body. Generally, when the tool body is rotated in a driving direction, a pawl of the pawl mechanism pushes against one of a series of teeth on the tool body which rotates the fastener engaging mechanism and the fastener in the driving direction. When the tool body is rotated in a return direction, the pawl mechanism ratchets past the teeth and the fastener engaging mechanism and fastener remain stationary. This type of ratchet mechanism is disadvantageous for several reasons including because the pawl mechanism requires that the tool body be returned through at least a minimum arc length to enable the pawl mechanism to ratchet past at least one ratchet tooth before the tool body is moved again in the driving direction. Wrenches using this type of ratcheting mechanism require a minimum clearance area to allow the wrench to the rotated through the minimum arc length required to cause the pawl tooth to ratchet past at least one tooth and therefore are not usable when this minimal space is not available.

Some wrenches utilize a plurality of pins or rollers operatively connected between the tool body and the fastener engaging mechanism. Examples are disclosed in U.S. Pat. No. 6,276,239 issued to Albertson, U.S. Pat. No. 5,115,699 issued to Mertens and U.S. Pat. No. 6,202,513 issued to Pan. Heretofore, wrenches of this type have had several disadvantages, including, for example, their mechanically complexity and difficulty of manufacturing.

SUMMARY OF THE INVENTION

One aspect of the present invention may be embodied in a hand tool for applying torque to a threaded fastener, the hand tool comprising an elongated tool body having a grippable portion at one end portion thereof configured to be gripped by a hand of a worker and having an opening at an opposite end portion thereof defining a rotational axis. A fastener engaging mechanism is rotatably mounted in the opening for bi-directional rotational movement with respect to the tool body about the rotational axis of the opening. The fastener engaging mechanism is configured to be releasably coupled in torque-applying relation to a fastener to which a torque is to be applied. The hand tool includes a driving direction control assembly comprising a cylindrical roller, a spring assembly and a driving direction control switch. The control switch is mounted for movement with respect to the tool body and the fastener engaging mechanism between first and second operative switch positions. The control switch, the spring assembly and the cylindrical roller are constructed and arranged such that (1) when the control switch is in its first operative switch position and the fastener engaging mechanism is releasably coupled to a fastener, the cylindrical roller is positioned such that (a) rotating the tool body about the rotational axis in a first rotational direction forces the cylindrical roller essentially instantaneously into a first wedged relation between surfaces on the tool body and the fastener engaging mechanism, thereby preventing relative rotational movement between the fastener engaging mechanism and the tool body so that rotational movement of the tool body in the first rotational direction rotates the fastener in the first rotational direction and (b) rotating the tool body about the rotational axis in a second rotational direction opposite the first rotational direction moves the cylindrical roller against the biasing of the spring assembly out of the first wedged relation, thereby allowing the tool body to rotate relative to the fastener engaging mechanism and (2) when the control switch is in its second operative switch position and the fastener engaging mechanism releasably coupled to a fastener, the cylindrical roller is positioned such that (a) rotating the tool body about the rotational axis in the second rotational direction forces the cylindrical roller essentially instantaneously into a second wedged relation between surfaces on the tool body and the fastener engaging mechanism, thereby preventing relative rotational movement between the fastener engaging mechanism and the tool body so that rotational movement of the tool body in the second rotational direction rotates the fastener in the second rotational direction and (b) rotating the tool body about the rotational axis in the first rotational direction moves the cylindrical roller against biasing of the spring assembly out of the second wedged relation, thereby allowing the tool body to rotate relative to the fastener engaging mechanism.

Other aspects, features, and advantages of the present invention will become apparent from the following detailed description of the illustrative embodiment, the accompanying drawings, and the appended claims.

DETAILED DESCRIPTION OF THE ILLUSTRATIVE EMBODIMENTS

Figure 1:
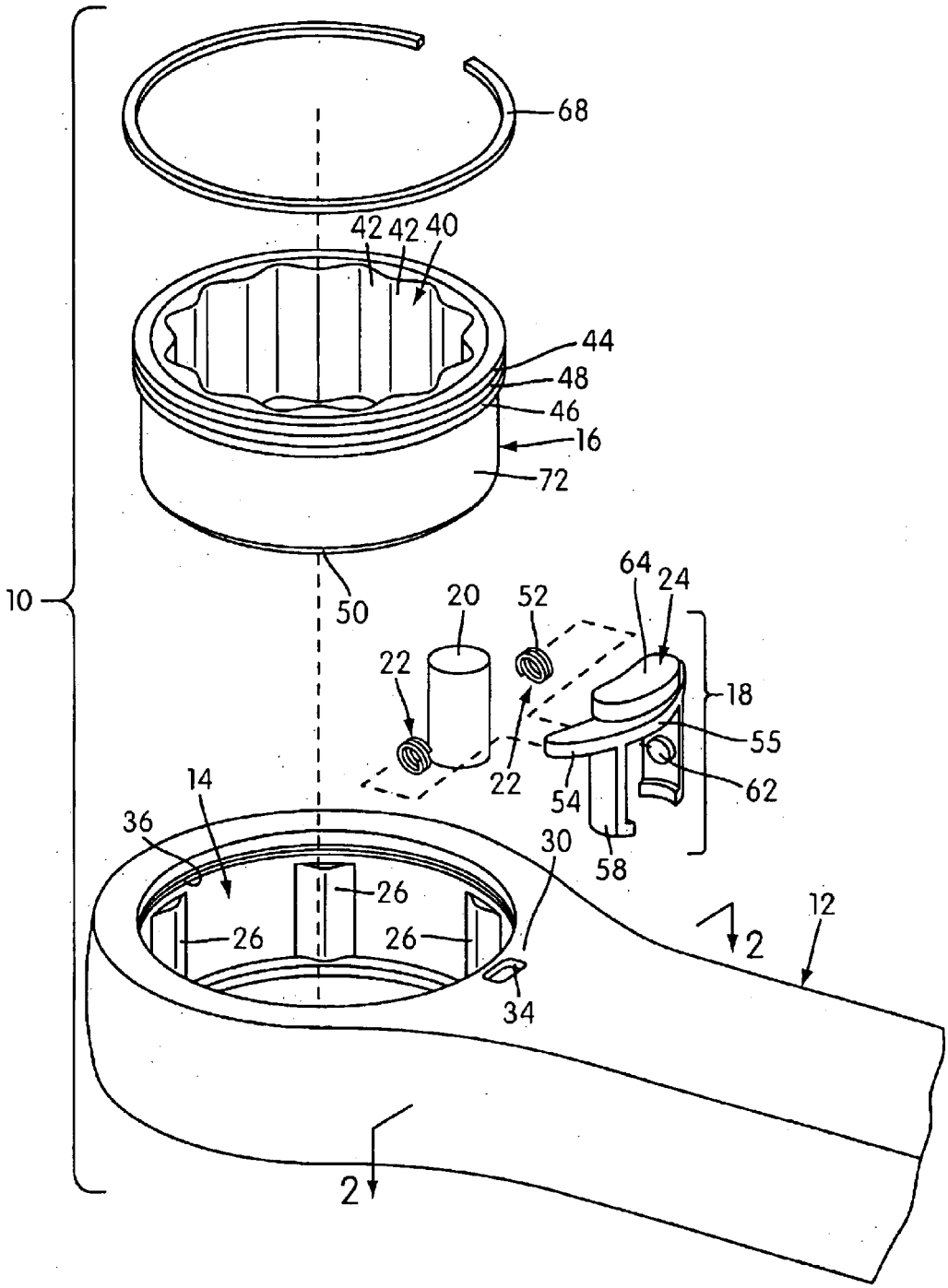
FIG. 1 is an exploded view of a hand tool constructed in accordance with one illustrative embodiment of the present invention.

FIGS. 1–4 illustrate an example of a hand tool constructed according to principles of the present invention. The illustrative embodiment of FIGS. 1–4 is in the form of a wrench 10 for applying a torque to a threaded fastener. The hand tool 10 includes an elongated tool body 12 having a grippable portion at one end portion thereof configured to be gripped by a hand of a worker and having an opening 14 at an opposite end portion. A fastener engaging mechanism 16 is mounted in the opening 14 for bi-directional rotational movement with respect to the tool body 12 and is configured to be releasably coupled in torque-applying relation to a fastener to which a torque is to be applied.

The hand tool 10 includes a driving direction control assembly 18 that includes a cylindrical roller 20, a spring assembly 22 and a driving direction control switch 24. The control switch 24 can be moved between two switch positions to control the driving direction of the wrench 10. The roller 20 is operatively engaged with the tool body 12 and the fastener engaging mechanism 16 such that when the wrench 10 is rotated in a driving direction, the roller 20 is wedged between the fastener engaging mechanism 16 and the tool body 12 to lock the fastener engaging mechanism 16 to the tool body 12 to rotate a fastener. Also, when the wrench 10 is rotated through a return stroke, the roller 20 allows relative movement between the tool body 12 and the fastener engaging mechanism 16 so that the fastener remains stationary during the return stroke. When the tool body is rotated again in a driving direction, the roller 20 re-locks the fastener engaging mechanism 16 to the tool body 12 essentially instantaneously (i.e., without any significant lost motion between the fastener engaging mechanism 16 and the tool body 12). The return stroke can be of any angular or arc length. Thus, regardless of the arc length of the return stroke, the control assembly 18 is operative to essentially instantaneously relock the fastener engaging mechanism 16 with the tool body 12 so that there is no lost motion when applying a drive stoke.

The tool body 12 is an integral structure which may be constructed of a metallic material such as a steel. The grippable portion is configured to be gripped by a hand of a worker when the worker is rotating a fastener with the wrench 10. The opening 14 extends through the tool body 12 and defines a rotational axis for the fastener engaging mechanism 16. A plurality of axially extending integral support structures 26 are formed about the opening 14 (see FIG. 2, for example). A control assembly recess 28 is formed within the tool body 12 adjacent the opening 14 (see FIG. 2, for example). The recess 28 is disposed between a pair of wall structures 30, 32 integrally formed on the tool body 12 (see FIG. 3, for example). A switch opening 34 is formed in wall structure 30. An annular recess 36 and an annular lip or flange 38 are formed within the opening 14 (see FIG. 3, for example). A switch arm recess 39 is formed within the tool body 12 adjacent the control assembly recess 28 (see FIG. 4, for example). A pair of openings 41, 43 are formed on each end of the switch arm recess 39.

The fastener engaging mechanism 16 is an integral structure constructed of a metallic material such as a steel and is configured to be releasably coupled to a fastener (e.g., a nut, a bolt). The illustrative fastener engaging mechanism 16 is a ring-shaped socket having an opening 40 extending therethrough. The interior 42 of the opening 40 is configured to releasably engage a square or hexagonal fastener such as a nut or a bolt. A pair of integral annular wall structures 44, 46 are formed about one end of the fastener engaging mechanism 16. The wall structures 44, 46 define an annular groove 48 therebetween. An annular recess 50 is formed about an opposite end of the fastener engaging mechanism 16.

The roller 20 is a cylindrical structure and may be constructed of a metallic material such as steel. The spring assembly 22 includes a pair of coil springs 51, 52.

The control switch 24 may be constructed of a metallic material and may be of one-piece construction or multi-piece construction. The control switch 24 includes a pair of flexible switch arms 54 extending outwardly from a body portion 55 of the control switch 24. Each switch arm 54 includes an integral projection or detent structure 56. A pair of leg portions 58 extend integrally from the body portion 55. A post 62 is formed on each leg portion 58, 60. A manually engageable portion 64 of the control switch 24 is connected to the body portion 55 of the control switch 24 by a neck portion 66. The manually engageable portion 64 may be a separate piece or structure that is secured to the neck portion 66 by a fastener, an adhesive or other appropriate means.

Construction and Operation

The fastener engaging mechanism 16 is rotatably mounted in the opening 14 of the tool body 12 utilizing a C-shaped ring 68. A portion of the C-shaped ring is disposed in the recess 48 on the exterior of the socket and a portion of the C-shaped ring is disposed in the recess 36 formed in the opening 14 of the tool body 12 (see FIG. 3, for example). The C-shaped ring may be used to permanently mount the socket 16 in the opening 14 in the tool body 12. When the fastener engaging mechanism 16 is mounted in the opening 14, the annular flange 38 on the tool body 12 is positioned within the recess 50 in the fastener engaging mechanism 16. The support structures 26 slidably engage the fastener engaging mechanism 16. The fastener engaging mechanism 16 is freely rotatable in both rotational directions within the opening 14 and the opening 14 generally defines an axis of rotation of the fastener engaging mechanism 16 with respect to the tool body 12.

Figure 2:
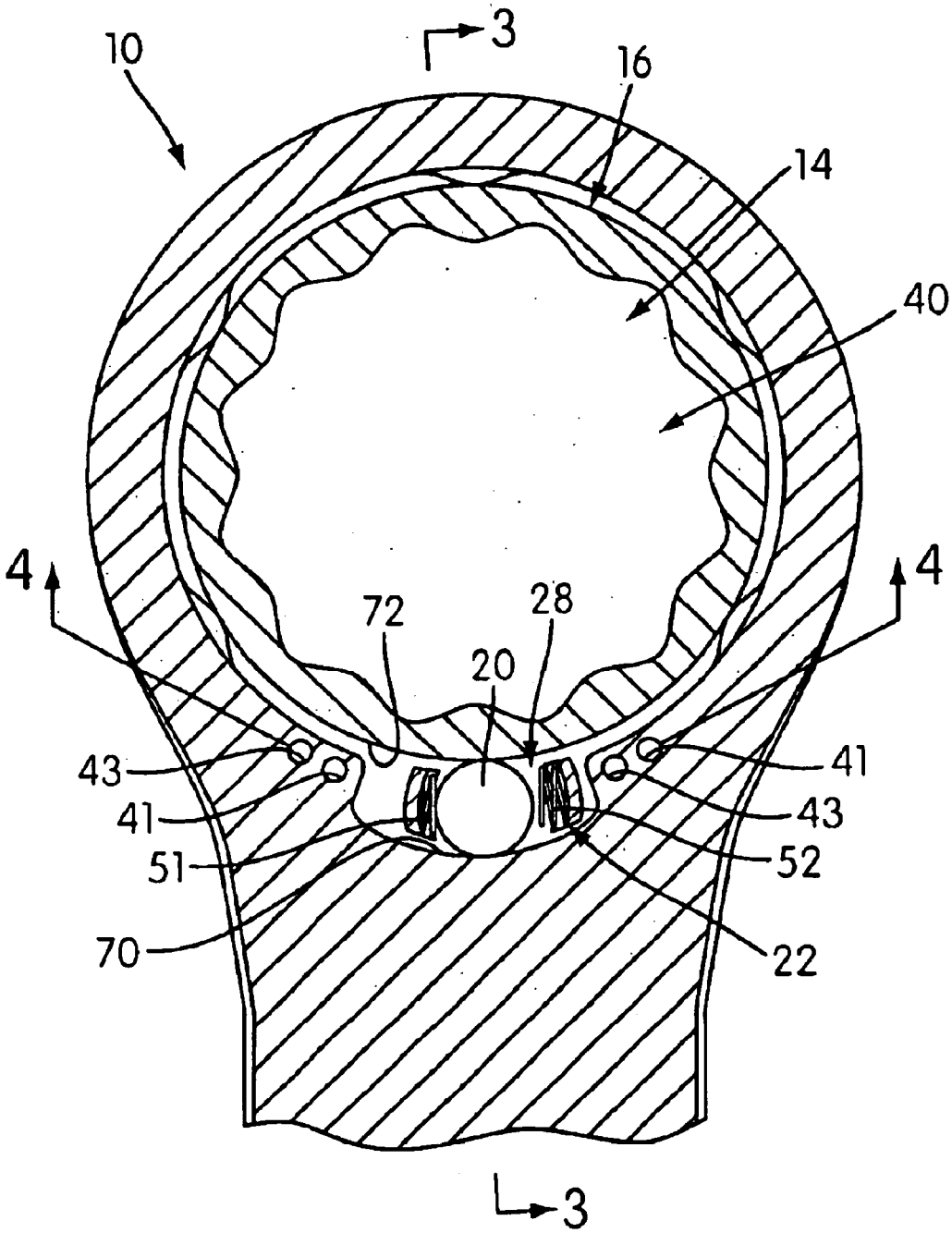
FIG. 2 is a cross-sectional view of the assembled hand tool of FIG. 1 taken through 2—2 as indicated in FIG. 1.
Figure 3:
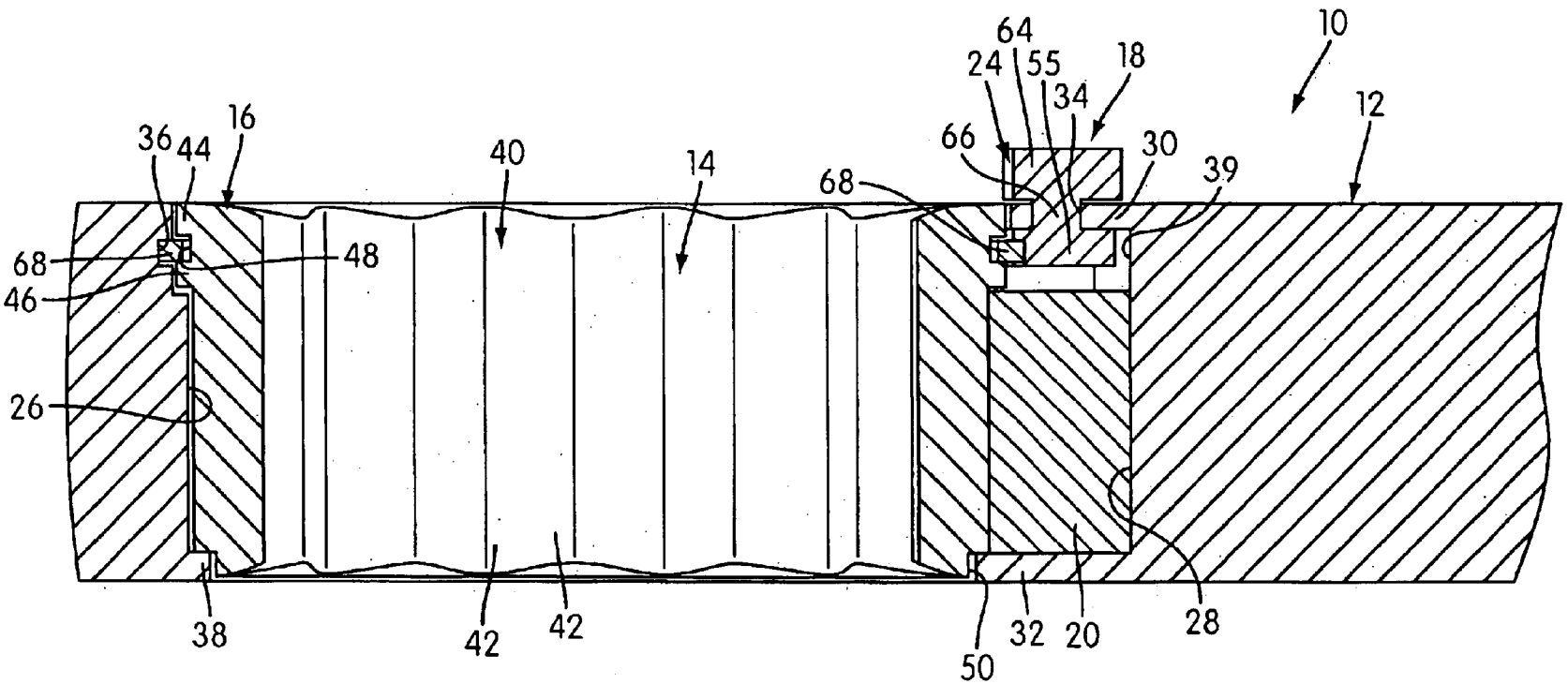
FIG. 3 is a cross-sectional view of the assembled hand tool of FIG. 1 taken through 3—3 as indicated in FIG. 2.
Figure 4:
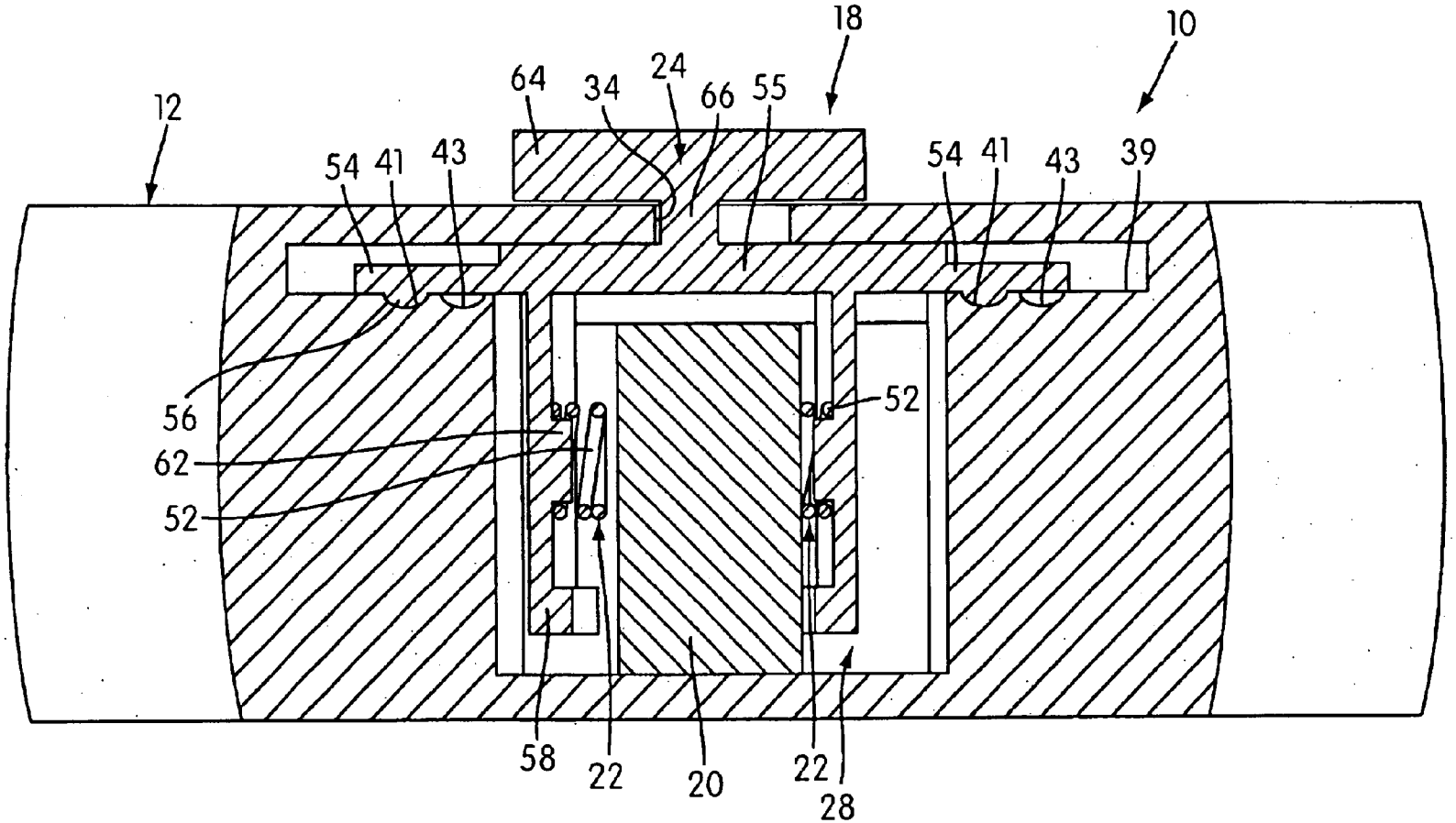
FIG. 4 is a cross-sectional view of the hand tool of FIG. 1 taken through 4—4 as indicated in FIG. 2.

The control assembly 18 is mounted in the tool body 12 in a manner which can be appreciated from FIGS. 2–4. The flexible arms 54 of the control switch 24 are slidably disposed in the switch arm recess 39 and the legs 58 of the control switch 24 extend into the control assembly recess 28. The manually engagable portion 64 of the control switch 24 is disposed on the exterior of the tool body 12. The control switch 24 may be located on the tool body 12 between the opening 14 in the tool body 12 and the grippable portion of the tool body 12 so that the manually engagable portion 64 of the control switch 24 can be easily moved between first and second switch positions using, for example, the thumb or digit of the hand gripping the tool body 12. This positioning of the control assembly 18 is preferred in some instances, but is not required by the invention and the control assembly 18 may be mounted in operative relation to the fastener engaging mechanism 16 and the tool body 12 in any location on the tool body 12.

The control switch 24 is mounted for movement with respect to the tool body 12 and the fastener engaging mechanism 16 between first and second operative switch positions. A coil spring 51, 52 is mounted on each post 62 on the control switch 24. The roller 20 is positioned between the coil springs 51, 52 and between the fastener engaging mechanism 16 and the tool body 12 (see FIG. 2, for example).

Figure 6:
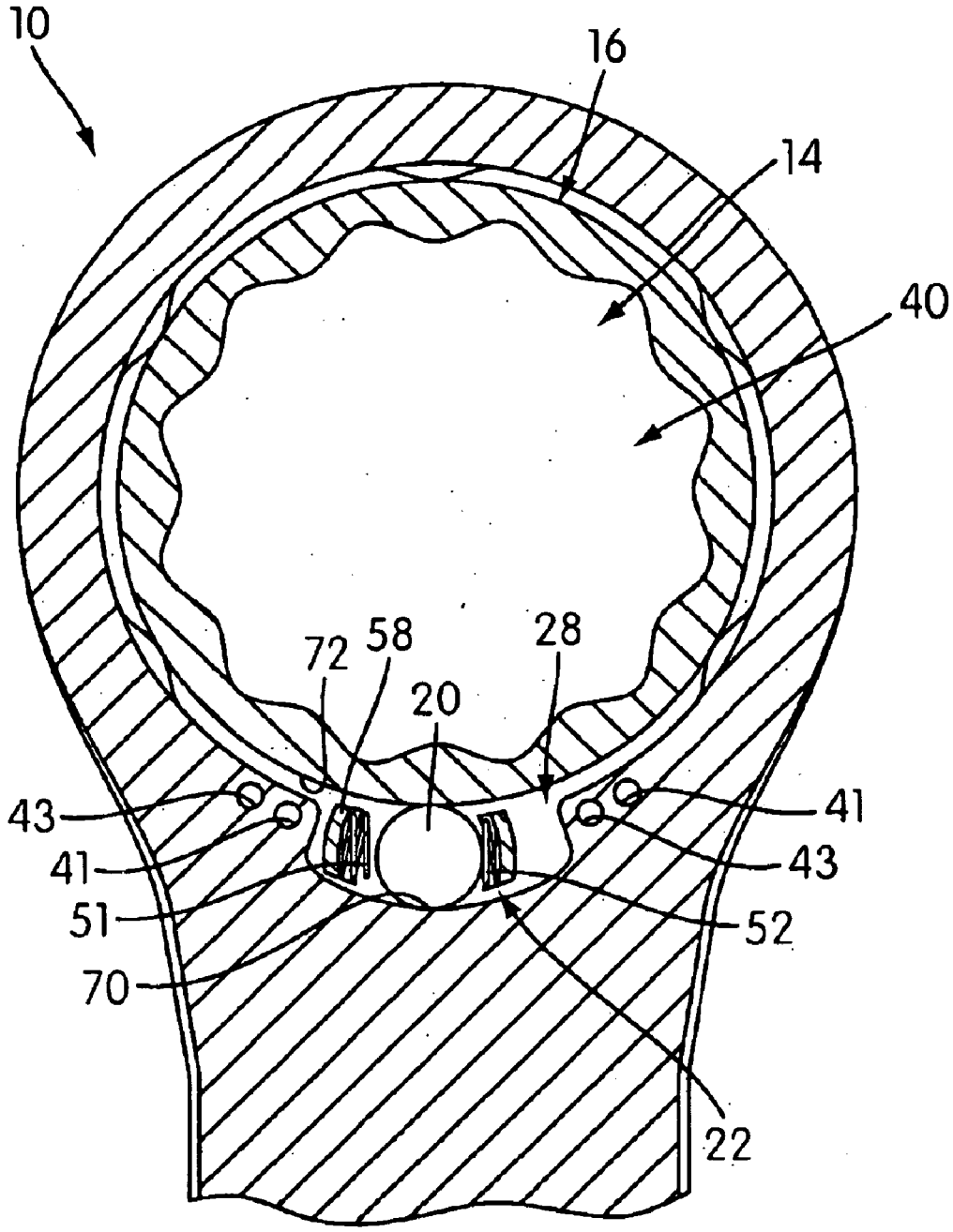
FIG. 6 shows a view similar to FIG. 2 except showing a control switch of the hand tool in a different switch position from the position illustrated in FIG. 2.

The control switch 24 is slidably mounted on the tool body 12 for movement between a first switch position (see FIG. 2) and a second switch position (see FIG. 6). As will become apparent, the position of the control switch 24 determines the driving direction of the wrench 10. That is, moving the control switch 24 from one switch position to the other switch position reverses the driving direction of the wrench 10.

The operation of the wrench 10 can be understood from FIG. 2. When the control switch 24 is in its first switch position, the coil spring 51 of the spring assembly 22 biases the roller 20 against surfaces on the tool body 12 and on the fastener engaging mechanism 16. The coil spring 51 biases the roller 20 against the tool body 12 and the fastener engaging mechanism 16 during both the drive stroke and the return stroke. A wall surface 70 of the control assembly recess 28 is shaped such that when the fastener engaging mechanism 16 is releasably coupled to a fastener and the tool body 12 is rotated with respect to the fastener and with respect to the fastener engaging mechanism 16 about the rotational axis defined by the opening 14 in the tool body 12 in a clockwise or first rotational direction (from the point of view of FIG. 2), the roller 20 essentially instantaneously wedges between the wall surface 70 on the tool body 12 and a cylindrical exterior surface portion 72 on the fastener engaging mechanism 16. This wedging action prevents relative rotational movement between the fastener engaging mechanism 16 and the tool body 12 as the tool body 12 is rotated in the clockwise direction through a drive stroke. Thus, rotational movement of the tool body 12 in the clockwise direction rotates the fastener in the clockwise rotational direction.

The wall surface 70 is also shaped such that when the tool body 12 is rotated through a return stroke (that is, in a counterclockwise or second rotational direction from the point of view of FIG. 2), the roller 20 is not wedged between the tool body and the fastener engaging mechanism 16 to allow relative rotational movement between the tool body and the faster engaging mechanism 16. During the return stroke, the spring assembly 22 biases the roller 20 against surfaces 70, 72 on the tool body 12 and the fastener engaging mechanism 16, respectively, during relative movement therebetween so that further movement of the tool body in the first rotational direction wedges the roller 20 essentially instantaneously between the surfaces 70, 72 on the tool body 12 and the fastener engaging mechanism 16, respectively, so that rotational movement of the tool body 12 in the first rotational direction rotates the fastener engaging mechanism 16 and the fastener in the first rotational direction with no significant lost motion between the tool body 12 and the fastener engaging mechanism 16. The return stroke can be of any arc length. It can also be appreciated from FIG. 2, for example, that the support structures 26 and the roller 20 are approximately equally circumferentially spaced about the periphery of the fastener engaging mechanism 16 to facilitate rotation of the fastener engaging mechanism 16 with respect to the tool body 12.

The control switch 24 is releasably locked in its first and second switch positions by a detent mechanism comprising the detent structures 56 and the recesses 41, 43. Specifically, when the control switch 24 is releasably locked in its first switch position, the detent structures 56 are disposed in the recesses 41 and when the control switch 24 is releasably locked in its second switch position, the detent structures 56 are disposed in the recesses 43. A worker can slide the control switch 24 between the first switch position (FIG. 2) and the second switch position (FIG. 6) by applying manual pressure to the manually engagable portion 64 of the control switch 24. The switch arms 54 are flexible to allow the detent structures 56 to move in and out of the recesses 41, 43.

When the control switch 24 is in its second switch position, the roller 20 is in the position illustrated in FIG. 6. In this portion of the control switch 24, the coil spring 52 biases the roller 20 against the wall surface 70 of the tool body 12 and the surface portion 72 of the fastener engaging mechanism 16 during both the drive and return strokes. The wall surface 70 is shaped such that when the fastener engaging mechanism 16 is releasably coupled to a fastener and the tool body 12 is rotated with respect to the fastener and with respect to the fastener engaging mechanism 16 about the rotational axis defined by the opening 14 in the tool body 12 in a counterclockwise direction (from the point of view of FIG. 6), the roller 20 essentially instantaneously wedges between the wall surface 70 on the tool body 12 and a cylindrical exterior surface portion 72 on the fastener engaging mechanism 16 so that the counterclockwise rotational movement of the tool body 12 rotates the fastener engaging mechanism 16 and the fastener in the counterclockwise direction.

The wall surface 70 is shaped such that when the control switch 24 is in its second switch position and the tool body 12 is rotated through its return stroke (that is, in a clockwise rotational direction from the point of view of FIG. 6), the roller 20 is released from wedging engagement between the tool body 12 and the fastener engaging mechanism 16 to allow relative movement between the tool body 12 and the faster engaging mechanism 16. During the return stroke, the coil spring 52 biases the roller 20 against surfaces 70, 72 on the tool body 12 and the fastener engaging mechanism 16 during relative movement therebetween so that further movement of the tool body 12 in the counterclockwise rotational direction essentially instantaneously wedges the roller 20 between the surfaces 70, 72 on the tool body 12 and the fastener engaging mechanism 16, respectively, without lost motion between the tool body 12 and the fastener engaging mechanism 16.

Figure 5:
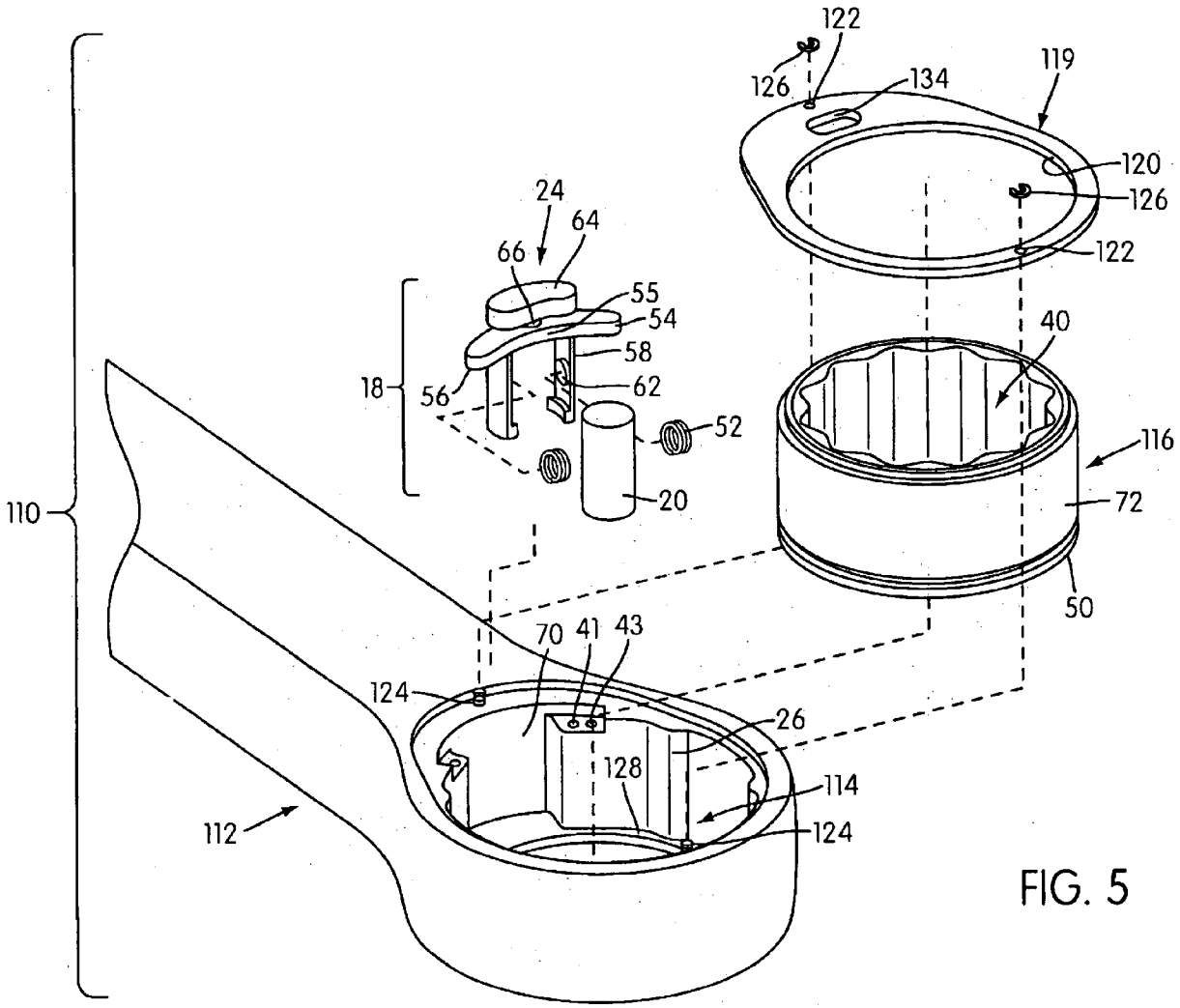
FIG. 5 is an exploded view of another illustrative embodiment of the present invention.

FIG. 5 shows another illustrative embodiment of a wrench 110 constructed according to principles of the present invention. Structures and portions of the wrench 110 that are identical to corresponding structures and portions of the wrench 10 are identified with identical reference numbers and are not discussed further. The fastener engaging mechanism 116 of the wrench 110 is in the form of a socket 116 that is identical to the socket 16 except that the socket 116 does not include structures corresponding to the integral annular wall structures 44, 46 and the annular groove 48 of socket 16. The socket 116 is removably mounted in the interior of the opening 114 of the tool body 112 using a removable cover structure 119. The cover structure 119 includes a central opening 120, a switch opening 134 for the control switch 24 and a pair of openings 122 that receive posts 124 formed on the tool body 112 of the wrench 110.

The cover structure 119 is secured to the tool body 112 utilizing a pair of C-shaped clamps 126 which are releasably engaged to the posts 124 when the cover structure 1 19 is in place. The opening 114 in the tool body 112 extends through the tool body 112. The tool body 112 includes an integral annular lip 128 surrounding one axial end of the opening 114 and extending into the opening 114. The cover structure 119 is removably secured at an opposite end of the opening 114 from the axial end on which the annular lip 128 is formed. The fastener engaging mechanism 116 is removably mounted in the opening 114 between the annular lip 128 and the cover structure 119 when the cover structure 119 is secured to the tool body 112. The fastener engaging mechanism 116 is removable from the tool body 112 when the cover structure 119 is removed from the tool body 112. The socket 116 can be removed and replaced by another ring-shaped socket or by a socket that includes a rectangular post axially aligned with the axis of the opening 114. The post may include a detent mechanism or other mechanism to receive and releasably hold a socket which can be removably attached to a fastener.

It can be appreciated that the embodiments of the invention described herein are intended to illustrate principles of the invention only and are not intended to limit the scope of the invention. Other embodiments are contemplated and within the scope of the present invention. Variations on the embodiments described herein are also contemplated and are within the scope of the invention. For example, although the invention has been illustrated using a fastener engaging mechanism in the form of a ring-shaped socket, other mechanisms for engaging a fastener directly or indirectly may be mounted within the opening of the tool body of a wrench constructed according to the principles of the present invention. For example, the fastener engaging mechanism could be in the form of an axially extending post constructed to the releasably coupled to a fastener engaging socket. An elongated post structure may extend from one side of the opening in the tool body or a pair of the elongated post structures may extend from respective opposite sides of the opening in the tool body. Each elongated post structure may be configured to be removably coupled to a socket which can be removably coupled to a fastener. It can also be appreciated that although the control assembly illustrated utilized two springs to position the roller, this is not required and more or fewer springs could be used.

Thus, while the invention has been disclosed and described with reference with a limited number of examples and embodiments, it will be apparent that variations and modifications can be made thereto without departure from the spirit and scope of the invention and various other modifications may occur to those skilled in the art. The following claims are intended to cover modifications, variations, and equivalents thereof.

What is claimed is:

1. A hand tool for applying a torque to a threaded fastener, said hand tool comprising:

an elongated tool body having a grippable portion at one end portion thereof configured to be gripped by a hand of a worker and having an opening at an opposite end portion thereof defining a rotational axis;

a fastener engaging mechanism rotatably mounted in said opening for bi-directional rotational movement with respect to said tool body about the rotational axis of said opening, said fastener engaging mechanism being configured to be releasably coupled in torque-applying relation to a fastener to which torque is to be applied;

a driving direction control assembly comprising a cylindrical roller, a spring assembly and a driving direction control switch, said control switch being mounted for movement with respect to said tool body and said fastener engaging mechanism between first and second operative switch positions, said control switch, said spring assembly and said cylindrical roller being constructed and arranged such that (1) when said control switch is in its first operative switch position and said fastener engaging mechanism is releasably coupled to a fastener, said cylindrical roller is positioned such that (a) rotating said tool body about the rotational axis in a first rotational direction forces said cylindrical roller essentially instantaneously into a first wedged relation between surfaces on said tool body and said fastener engaging mechanism, thereby preventing relative rotational movement between said fastener engaging mechanism and said tool body so that rotational movement of said tool body in the first rotational direction rotates the fastener in the first rotational direction and (b) rotating said tool body about the rotational axis in a second rotational direction opposite the first rotational direction moves the cylindrical roller against the biasing of the spring assembly out of the first wedged relation, thereby allowing said tool body to rotate relative to said fastener engaging mechanism, and (2) when said control switch is in its second operative switch position and said fastener engaging mechanism is releasably coupled to a fastener, said cylindrical roller is positioned such that (a) rotating said tool body about the rotational axis in the second rotational direction forces said cylindrical roller essentially instantaneously into a second wedged relation between surfaces on said tool body and said fastener engaging mechanism, thereby preventing relative rotational movement between said fastener engaging mechanism and said tool body so that rotational movement of said tool body in the second rotational direction rotates the fastener in the second rotational direction and (b) rotating said tool body about the rotational axis in the first rotational direction moves the cylindrical roller against biasing of the spring assembly out of the second wedged relation, thereby allowing said tool body to rotate relative to said fastener engaging mechanism.

2. A hand tool according to claim 1, said spring assembly comprising a pair of coil springs each being mounted to said control switch on opposing sides of the cylindrical roller.

3. A hand tool according to claim 2, wherein said control switch is located on said tool body between said opening therein and said grippable portion thereof.

4. A hand tool according to claim 1, wherein said fastener engaging mechanism is permanently mounted in said opening in said tool body.

5. A hand tool according to claim 4, wherein said opening in said tool body extends through said tool body and wherein said fastener engaging mechanism is a socket having an opening therethrough, the interior of said socket being configured to releasably engage a nut or bolt.

6. A hand tool according to claim 5, further comprising a C-shaped ring, a portion of said C-shaped ring being disposed in a recess on the exterior of said socket and a portion of said C-shaped ring being disposed in a recess formed in said opening, said C-shaped ring thereby permanently mounting said socket in said opening in said tool body.

7. A hand tool according to claim 1, wherein said opening extends through said tool body, said tool body including an annular lip surrounding one end of said opening and extending into said opening, said hand tool further comprising a cover removablely mounted on said tool body, said cover covering an opposite end of said opening, said fastener engaging mechanism being removablely mounted in said opening between said annular lip and said cover, said fastener engaging mechanism being removable from said tool body when said cover is removed from said tool body.

8. A hand tool according to claim 7, wherein said fastener engaging mechanism includes a elongated structure extending axially outwardly from one side of said opening in said tool body along the rotational axis of said opening, said elongated structure being configured to be coupled to a socket which can be removablely coupled to a fastener.

9. A hand tool according to claim 1, wherein said control switch is releasably lockable in the first and second operative switch positions thereof.

10. A hand tool according to claim 9, further comprising a detent mechanism operable to releasably lock said control switch in the first and second operative switch positions thereof.

* * * * *